US007938677B1

(12) United States Patent
Zhu

(10) Patent No.: US 7,938,677 B1
(45) Date of Patent: May 10, 2011

(54) ELECTRICAL JUMPER WITH RETAINING ARRANGEMENTS

(75) Inventor: Yu Zhu, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/829,405

(22) Filed: Jul. 2, 2010

(30) Foreign Application Priority Data

Nov. 19, 2009 (CN) ..... 2009 2 0315138 U

(51) Int. Cl.
*H01R 31/08* (2006.01)

(52) U.S. Cl. ..... 439/510

(58) Field of Classification Search ..... 439/510, 439/512, 507

See application file for complete search history.

(56) References Cited

U.S. PATENT DOCUMENTS 4,602,834 A 7/1986 Hahn et al.
5,169,337 A * 12/1992 Ortega et al. ..... 439/510
5,655,927 A * 8/1997 Maue et al. ..... 439/510
5,669,787 A * 9/1997 Miyazawa ..... 439/510
5,782,655 A * 7/1998 Stefaniu et al. ..... 439/510
6,036,534 A * 3/2000 Hoyt et al. ..... 439/510
7,771,227 B1 * 8/2010 Yu et al. ..... 439/510

* cited by examiner

*Primary Examiner* — Gary F. Paumen
(74) *Attorney, Agent, or Firm* — Wei Te Chung; Andrew C. Cheng; Ming Chieh Chang

(57) ABSTRACT

An electrical jumper includes an insulative housing defining a receiving room having an inserting opening through which the pins are inserted to the receiving room and a one-piece terminal member assembled in the receiving room. The terminal member includes two contacts connecting with each other by two connecting portions. Each contact defines a base portion and a pair of elastic arms on two opposite sides of the base portion. The base portion of each contact further defines a rib protruding towards the receiving room. The insulative housing further defines arm portions having hook portions at free ends of the arm portions extending into the receiving room. The arm portions are movable with respect to the insulative housing. The rib and the hook portion resist on two opposite sides of the pin when the pins are inserted in the receiving room.

15 Claims, 6 Drawing Sheets

ELECTRICAL JUMPER WITH RETAINING ARRANGEMENTS

BACKGROUND OF THE INVENTION

1. Field of the Invention

The present invention relates to an electrical jumper, and more particularly to an electrical jumper with retaining arrangements to secure pins of electronic devices to the electrical jumper.

2. Description of the Related Art

U.S. Pat. No. 4,602,834 issued to Marlyn e. t. on Jul. 29, 1986 discloses a conventional electrical jumper for electrically connecting pins which extend from electronic devices mating with the electrical jumper. The electrical jumper includes an insulative housing and a terminal member retained in the housing. The terminal member includes two terminals. Each terminal includes two beams having free distal ends and defining a receiving passageway between two free distal ends. One pin of the electronic device is inserted into the receiving room of the terminal member through the free distal ends. After the pins of the electronic device have been inserted into the receiving room for several times, the terminal member is easy to distort due to an interferential force between the pins and the terminal member so as to electrically connect with the pins badly.

In view of the above, a new electrical jumper that overcomes the above-mentioned disadvantages is desired.

SUMMARY OF THE INVENTION

Accordingly, an object of the present invention is to provide an electrical jumper with retaining arrangements to secure pins of electronic devices which mate with the electrical jumper.

To fulfill the above-mentioned object, an electrical jumper comprises an insulative housing defining a receiving room having an inserting opening through which the pins are inserted to the receiving room and a one-piece terminal member assembled in the receiving room. The terminal member includes two contacts connecting with each other by connecting portions. Each contact defines a base portion and a pair of elastic arms on two opposite sides of the base portion. The base portion of each contact further defines a rib protruding towards the receiving room. The insulative housing further defines arm portions having hook portions at free ends of the arm portions extending into the receiving room. The arm portions are movable with respect to the insulative housing. The rib and the hook portion resist on two opposite sides of the pin when the pins are inserted in the receiving room.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Reference will now be made to the drawings to describe the present invention in detail.

Referring to FIGS. 1-4, an electrical jumper 100 for electrically connecting two pins which extend from electronic devices (not shown) includes an insulative housing 1 and a one-piece terminal member 2 assembled in the insulative housing 1. The terminal member 2 includes two contacts 3 having the same configuration.

Figure 1:
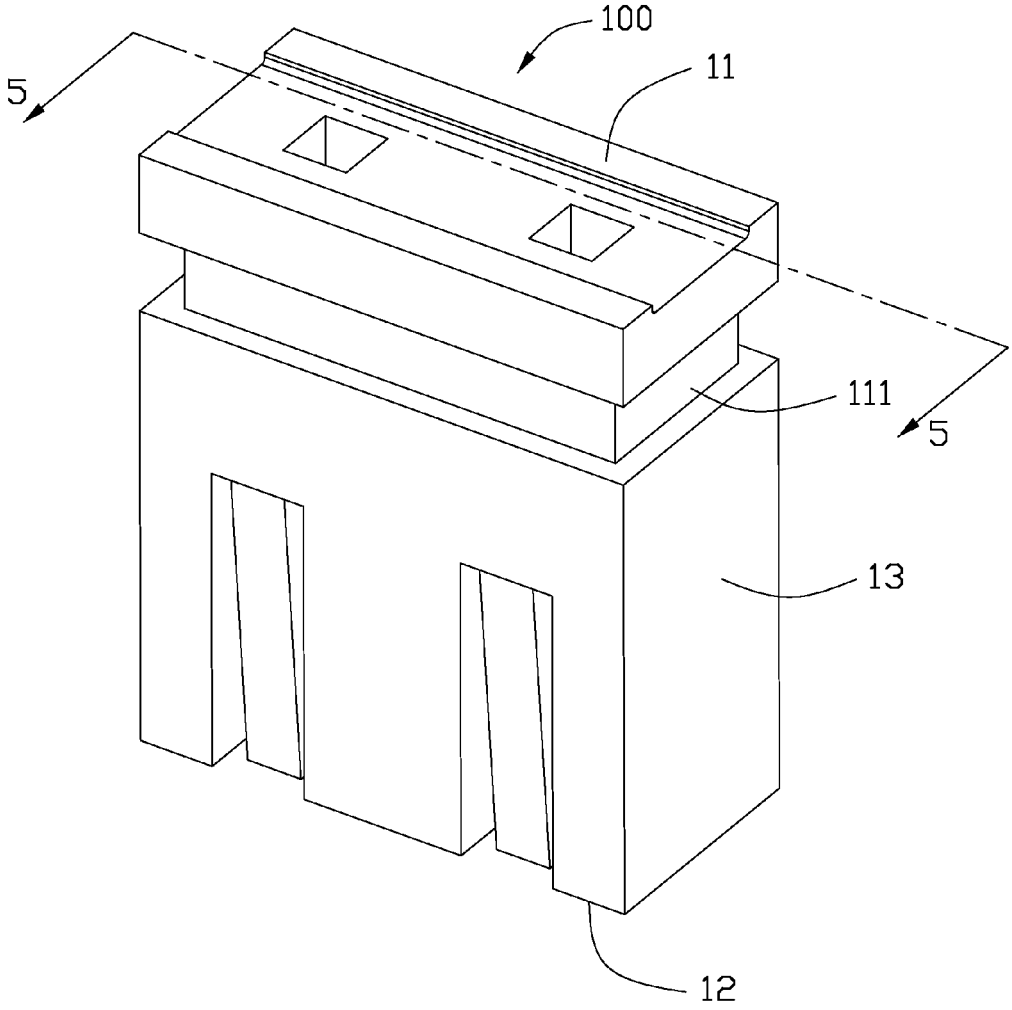
FIG. 1 is a top perspective view of an electrical jumper of the present invention.

Referring to FIG. 1, the insulative housing 1 is configured with a rectangle manner. The insulative housing 1 defines an upward face 11, a bottom mating face 12 and a plurality of peripheral walls 13 bridging the upward face 11 and the bottom face 12. A ring groove 111 parallel to the upward face 11 is formed around the peripheral walls 13 close to the upward face 11 so that the electrical jumper 100 is convenient to be fixed to or taken away from pins of the electronic device by catching the ring groove 111.

Figure 2:
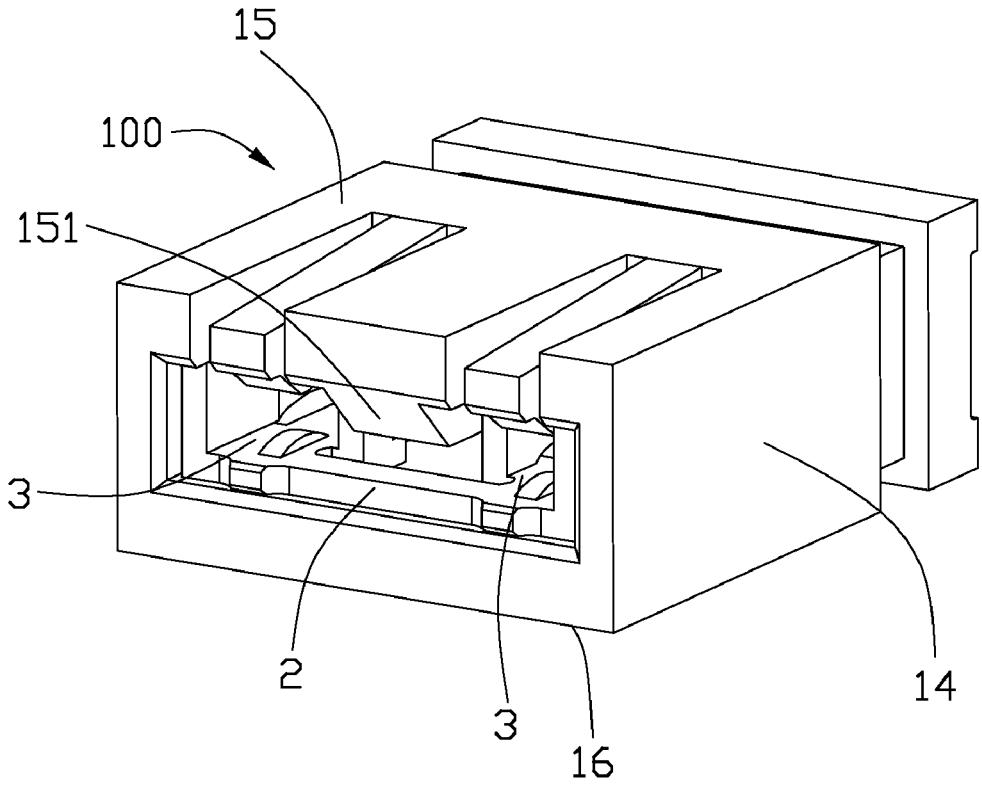
FIG. 2 is a bottom perspective view of the electrical jumper of FIG. 1 placed transversely.
Figure 3:
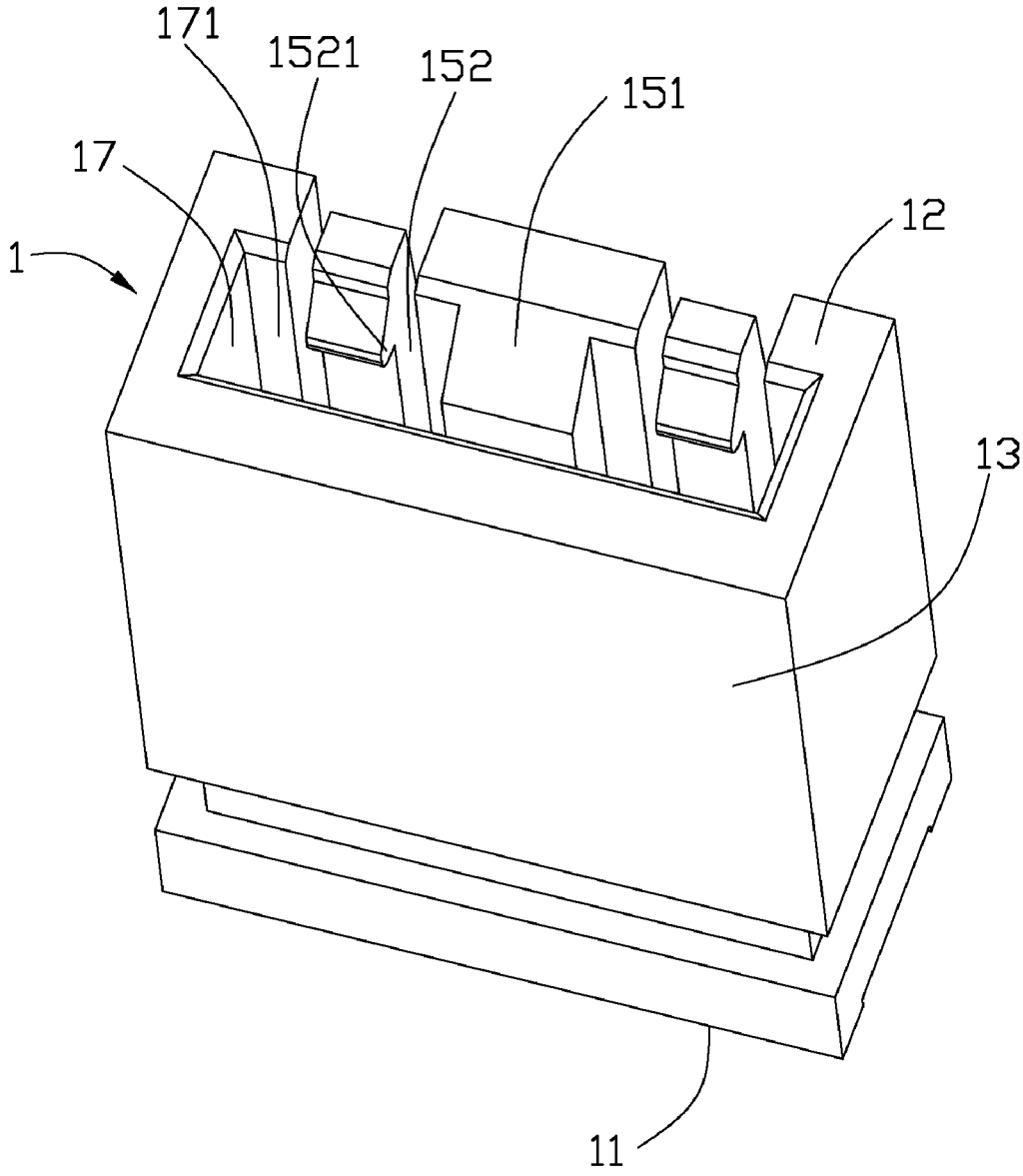
FIG. 3 is a bottom perspective view of a housing of the electrical jumper of the present invention.

Referring to FIG. 3, the peripheral walls 13 and the upward face 11 jointly define a receiving room 17. The receiving room 17 runs through the mating face 12 and forms an inserting opening 171. Referring to FIG. 2, the peripheral walls 13 include a first and second lengthwise sidewalls 15, 16 and a pair of widthwise sidewalls 14. The contacts 2 are inserted into the insulative housing 1 from the inserting opening 171. An inner face of the first lengthwise sidewall 15 defines a tuber 151 extending perpendicularly to the receiving room 17 and between the two contacts 3.

Figure 4:
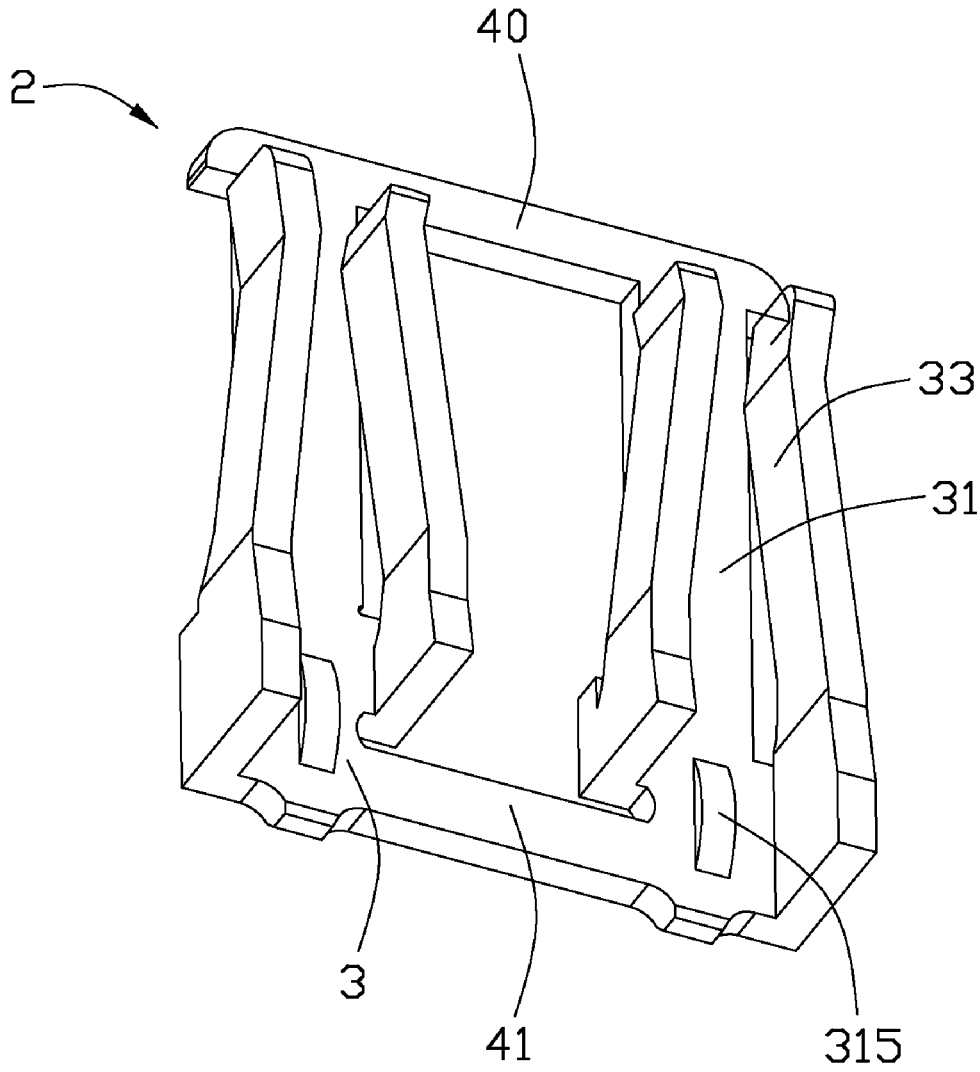
FIG. 4 is a perspective view of a terminal member of the electrical jumper of the present invention.
Figure 5:
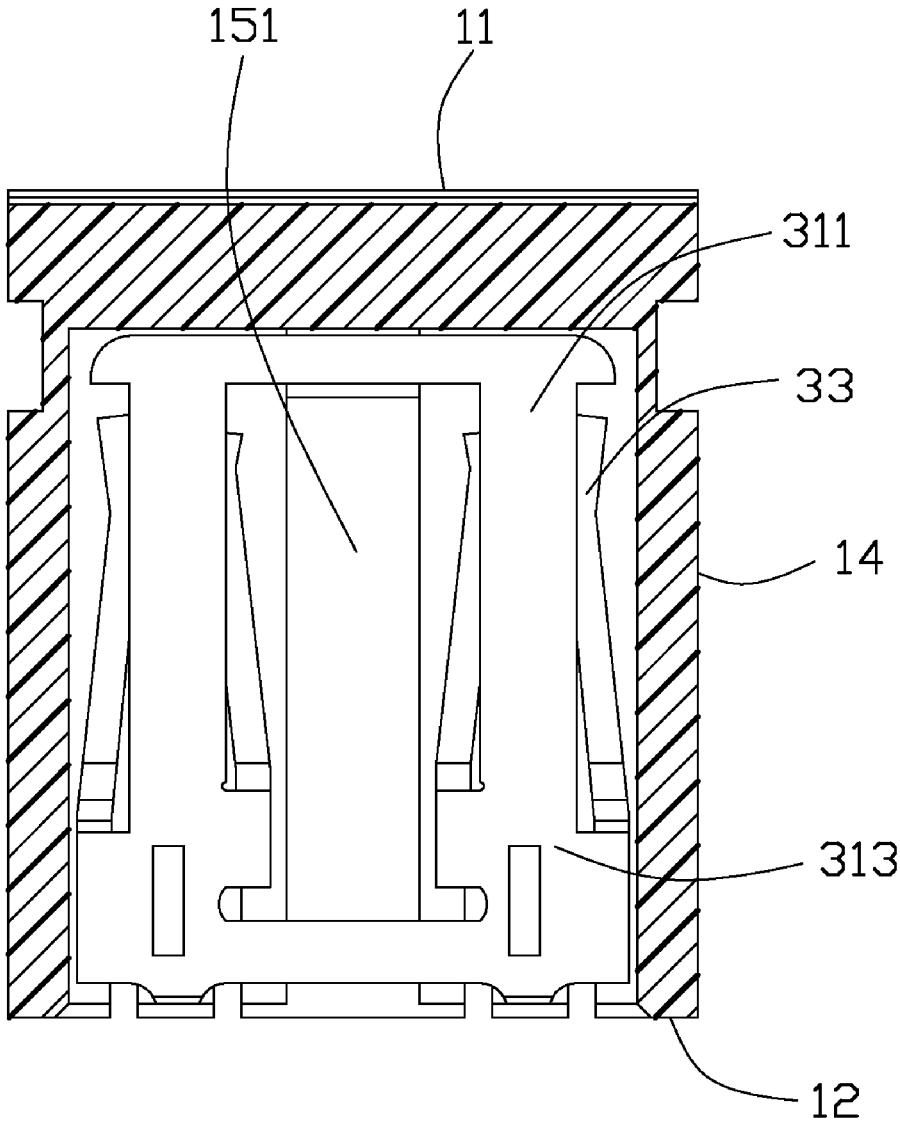
FIG. 5 is a cross sectional view of the electrical jumper taken along 5-5 in FIG. 1.

Referring to FIGS. 4-5, each contact 3 includes a base portion 31, and a pair of elastic arms 33 extending perpendicularly from two sides of the base portion 31 and having contacting points facing to each other. The base portion 31 defines a first end 311 close to the upward face 11 of the insulative housing 1 and a second end 313 close to the mating face 12. The elastic arms 33 are connecting with the second end 313, and extending slantwise along the base portion 31 reaching a point closest to the base portion 31 and then flaring slightly. A first connecting portion 40 is connecting with the first ends 311 of the two contacts 3 and a second connecting portion 41 is connecting with the second ends 313. The said connecting portion 40, 41 are planar with the two base portions 31. The two contacts 3 are integrated. Referring to FIG. 2, the connecting portion 40, 41 and the two base portions 31 resist on the second lengthwise wall 16. Two outside elastic arms 33 are respectively close to the widthwise walls 14. Two inside elastic arms 33 are located at and close to two sides of the tuber 151. The tuber 151 is between the two sides of the inside elastic arms 33. Free ends of the elastic arms 33 of two contacts 2 extend far away from the inserting opening 171.

Figure 6:
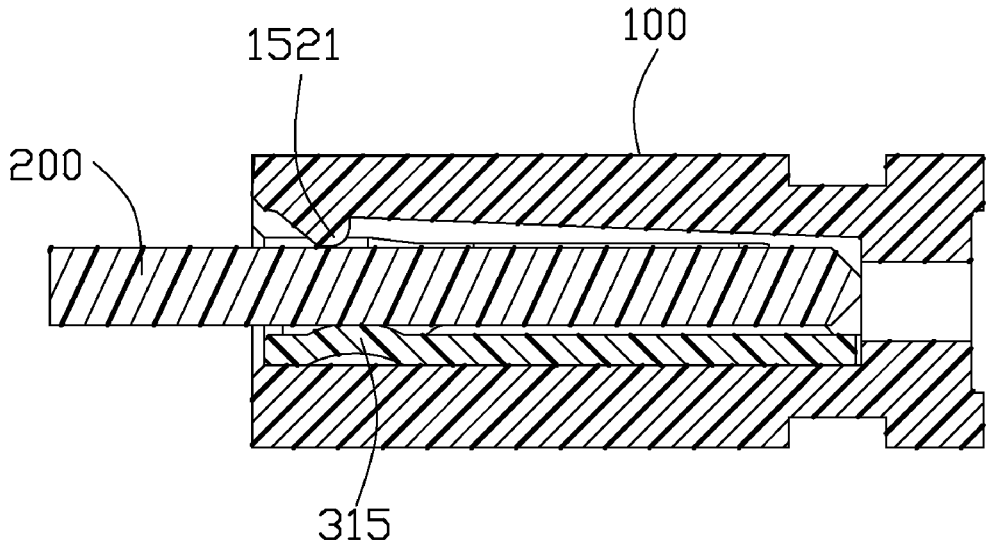
FIG. 6 is a cross sectional view of the electrical jumper into which a pin is inserted.

Referring to FIGS. 2-4, the first end 311 of each base portion 31 close to the inserting opening 121 further defines a rib 315 protruding towards the receiving room 17. The rib 315 of an arc shaped is between the two elastic arms 33 of the contact 3. The first lengthwise wall 15 further forms a pair of arm portions 152 having hook portions 1521 at a free end thereof and face to the ribs 315 of two contacts 3. The hook portion 1521 extends slantwise from the mating face 12 of arm portions 152 and far away from the first lengthwise wall 15. The arm portions 152 are splitting from the first lengthwise wall 15 and on two sides of the tuber 151. The free ends of the arm portions 152 are movable with respond to the ribs 315. Referring to FIG. 6, when the pin 200 is inserted into the housing 1, the hook portion 1521 and the rib 315 resist on two opposite sides of the pin 200 to retain the pin 200 in the insulative housing 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical jumper for electrically connecting two or more pins, comprising:

an insulative housing defining a receiving room having an inserting opening through which the pins are inserted to the receiving room;

a one-piece terminal member assembled in the receiving room and including two contacts connecting with each other by two connecting portions, each contact defining a base portion and a pair of elastic arms on two opposite sides of the base portion; wherein the base portion of each contact further defines a rib protruding towards the receiving room, the insulative housing further defines arm portions having hook portions at free ends of the arm portions extending into the receiving room, the arm portions being movable with respect to the insulative housing, the rib and the hook portion resist on two opposite sides of the pin when the pins are inserted in the receiving room.

2. The electrical jumper as claimed in claim 1, wherein each hook portion faces the corresponding rib of the contact.

3. The electrical jumper as claimed in claim 2, wherein the rib is configured with an arc-shaped manner.

4. The electrical jumper as claimed in claim 2, wherein the hook portion extends slantwise to the receiving room.

5. The electrical jumper as claimed in claim 1, wherein the insulative housing further defines a ring groove forming around peripheral walls of the receiving room.

6. The electrical jumper as claimed in claim 1, wherein the insulative housing further defines a tuber extending perpendicularly to the receiving room and between two contacts.

7. The electrical jumper as claimed in claim 1, wherein free ends of the elastic arms of two contacts extend far away from the inserting opening.

8. An electrical jumper comprising:

an insulative housing defining a receiving room with an inserting opening running through a mating face, the receiving room defined by a first wall and a second wall opposite to the first wall;

two contacts received in the receiving room, each comprising a base portion resting on the first wall, and a pair of elastic arms perpendicularly extending from two opposite sides of the base portion and having contacting points facing to each other; wherein the insulative housing defines a pair of arm portions splitting from the second wall and slanting to the pair of the elastic arms each with a hook portion at a free end.

9. The electrical jumper as claimed in claim 8, wherein the base portions of the contacts define ribs facing to the hook portions.

10. The electrical jumper as claimed in claim 9, wherein said two contacts connect with each other by two connecting portions jointing with the base portions thereof.

11. The electrical jumper as claimed in claim 10, wherein free ends of the elastic arms of two contacts extend far away from the inserting opening.

12. An electrical jumper comprising:

an insulative housing defining a pair of opposite long walls spaced from each other in a first direction, and a pair of short walls spaced from each other in a second direction perpendicular to said first direction, both said pair of long walls and said pair of short walls commonly defining a cavity in communication with an exterior in a third direction perpendicular to both said first direction and said second direction;

one of said long walls defining a pair of resilient arm portions with hook portions, at distal ends, protruding into the cavity in said first direction; and a unitary metal contact disposed in the cavity and including a base portion, two pair of elastic arms being located on two sides of the base portion and spaced from each other in said second direction, each of said pair of elastic arms defining a pin receiving passage for receiving a pin of a complementary connector; wherein the base portion defines a pair of inwardly extending ribs in alignment with not only the respective pin receiving passages in the third direction but also the pair of hook portions in the first direction.

13. The electrical jumper as claimed in claim 12, wherein each pair of said elastic arms define a converged distal end which is far spaced from the corresponding rib in said third direction.

14. The electrical jumper as claimed in claim 12, wherein said pair of hook portions performs a guiding function for the contact during rearwardly assembling the contact into the cavity from the exterior in the third direction.

15. The electrical jumper as claimed in claim 12, wherein a pair of connection portions extending along the second direction, are linked between said two pairs of elastic arms and spaced from each other in said third direction.

* * * * *